US008007608B1

(12) United States Patent
Herbage et al.

(10) Patent No.: US 8,007,608 B1
(45) Date of Patent: Aug. 30, 2011

(54) INFRARED TRACER COMPOSITION AND TRACER PROJECTILE

(75) Inventors: David W. Herbage, Jackson, TN (US); Roy L. Neuhauser, Oakland, TN (US); Barry N. Smith, Bethel Springs, TN (US)

(73) Assignee: Kilgore Flares Co., LLC, Toone, TN (US)

( * ) Notice: Subject to any disclaimer, the term of this patent is extended or adjusted under 35 U.S.C. 154(b) by 0 days.

(21) Appl. No.: 12/581,946

(22) Filed: Oct. 20, 2009

Related U.S. Application Data

(62) Division of application No. 11/023,078, filed on Dec. 27, 2004, now abandoned.

(51) Int. Cl.

| | |
|---|---|
| ***C06B 33/00*** | (2006.01) |
| ***C06B 29/02*** | (2006.01) |
| ***C06B 27/00*** | (2006.01) |
| ***D03D 23/00*** | (2006.01) |
| ***D03D 43/00*** | (2006.01) |

(52) U.S. Cl. ..... 149/37; 149/77; 149/87; 149/108.2; 149/108.6; 149/109.2; 149/109.4

(58) Field of Classification Search ..... 149/37, 149/77, 87, 108.2, 108.6, 109.2, 109.4
See application file for complete search history.

(56) References Cited

U.S. PATENT DOCUMENTS

| | | | | |
|---|---|---|---|---|
| 4,094,711 | A * | 6/1978 | Ramnarace | 149/4 |
| 5,639,984 | A * | 6/1997 | Nielson | 102/336 |
| 5,760,329 | A * | 6/1998 | Baum et al. | 102/439 |
| 2002/0121321 | A1 * | 9/2002 | Takayama et al. | 149/46 |

* cited by examiner

*Primary Examiner* — James McDonough
(74) *Attorney, Agent, or Firm* — H. Roy Berkenstock; Sarah Osborn Hill; Wyatt, Tarrant & Combs, LLP

(57) ABSTRACT

The present invention is directed to a tracer composition for tracer bullets and other projectiles. One preferred formula of the tracer composition generally includes about 58 parts by weight of magnesium, about 38 parts by weight of polytetraflouroethylene, about 4 parts by weight of acrylic rubber, and a burn rate stabilizer such as about 1.5 parts by weight of carbon black or graphite. Tracer bullets including the tracer composition of the invention tend to exhibit a projectile path that is almost unnoticeable to the naked eye but quite visible through the use of equipment detecting energy in the near infrared range.

6 Claims, 3 Drawing Sheets

40
42
44
Human Eye
Gen III Night Vision
IR Tracer
0.35
0.40
0.45
0.50
0.55
0.60
0.65
0.70
0.75
0.80
0.85
0.90
0.95
1.00
1.05
1.10
1.15
1.20
Wavelenth (microns)
Relative Sensativity / Output Intensity

INFRARED TRACER COMPOSITION AND TRACER PROJECTILE

RELATED APPLICATIONS

This is a divisional application which claims the benefit of U.S. patent application Ser. No. 11/023,078 which was filed on Dec. 27, 2004 and is hereby incorporated by reference.

STATEMENT REGARDING SPONSORED RESEARCH OR DEVELOPMENT

Not applicable.

REFERENCE TO A MICROFICHE APPENDIX

Not applicable.

FIELD OF THE INVENTION

The present invention is related to small caliber tracer projectiles or bullets, each of which may be expelled from a firearm such as a rifle or pistol. More particularly, the present invention relates to a tracer composition for small caliber projectiles bullets that, when ignited, emit a controlled amount of near infrared light to allow a flight path of the projectile to be tracked without causing a "bloom" in Generation III night vision systems.

BACKGROUND OF THE INVENTION

Tracer projectiles are often utilized in combat and warfare training to provide a visual trace of the path of a projectile. For instance, tracers may be used to gauge whether fired projectiles are impacting upon a desired target or whether adjustments in aim are desirable. One drawback of some conventional tracers utilized in combat is that they emit a significant amount of visible light, which may enable an enemy to discern a location of the source of the tracer projectile. Accordingly, use of these conventional tracers may allow an enemy to visually locate the source of the projectile bullet and to direct a counter-attack toward that location. However, when tracers are utilized in training, it is generally desirable to be able to visually discern the flight path of a tracer projectile without the need for using infrared vision equipment such as Generation III night vision goggles. This feature is generally desirable to enable viewers to discern the flight path of a tracer projectile regardless of whether or not the viewers are utilizing infrared vision equipment.

Tracer projectiles typically include a tracer composition that, when ignited, provides a spectral emission that allows the projectile path of the tracer to be tracked/viewed. Numerous conventional tracer compositions are capable of emitting varying levels of visible light but detrimentally emit significant levels of infrared light. Conversely, other conventional tracer compositions fail to emit sufficient levels of infrared light, thus, making it difficult to track the projectile path of the tracer projectile when using infrared detection. It is generally desirable to formulate these tracer compositions so that, when ignited, they emit a sufficient amount of infrared light to allow the projectile path of the tracer to be tracked/viewed through the use of infrared vision equipment over a significant distance. However, it is also quite desirable to formulate these tracer compositions so that, when ignited, the intensity of the infrared emissions provided does not cause infrared vision equipment to malfunction. For instance, if the intensity of the infrared emissions is too great, Generation III night vision goggles may malfunction (e.g., momentary shutdown referred to as a "bloom") causing the viewer to be temporarily blinded.

SUMMARY OF THE INVENTION

Accordingly, it is an object of the present invention to provide a tracer composition to be utilized in tracer projectiles that, when ignited, emits an effective amount of near infrared light. Relatedly, it is another object to provide a tracer composition that emits infrared energy at intensities sufficient to be traceable over projectile paths of significant distances. Further, it is still another object to provide a tracer composition that does not emit intensities of infrared energy that could cause Generation III night vision goggles to malfunction (e.g., bloom). These objectives, as well as others, may be met by the invention described below.

One aspect of the present invention is directed to an infrared tracer composition to be utilized in tracer projectiles. This tracer composition generally includes magnesium, polytetraflouroethylene, acrylic rubber, and a burn rate stabilizer. Various statements may be made in regard to relative amounts of each of the components of the tracer composition. For instance, in one embodiment, the amount of acrylic rubber in the composition may be greater than the amount of burn rate stabilizer in the composition. In another embodiment, the amount of acrylic rubber in the composition may be less than the amount of polytetraflouroethylene in the composition. In such an embodiment, the amount of acrylic rubber in the composition may be less than the amount of magnesium in the composition. However, while not necessarily always the case, it is generally preferred that the amount of polytetraflouroethylene in the composition be less than an amount of magnesium in the composition.

Another aspect of the invention is directed to a tracer that includes a projectile body and an ignitable tracer composition. The ignitable tracer composition includes acrylic rubber, and at least a portion of the tracer composition is disposed generally within a portion of the projectile body. This tracer composition may include other components. For instance, the tracer composition may include magnesium or other appropriate tracer fuel such as, but not limited to aluminum and boron. As another example, the tracer composition may include an appropriate oxidizer such as, but not limited to, polytetraflouroethylene, vinylidene, and strontium nitrate. Further, the tracer composition may include one or more appropriate burn rate stabilizers such as carbon black, graphite, and zirconium carbide.

In some embodiments, the tracer projectile also includes an igniter for igniting the tracer composition. This igniter may be any appropriate igniting mechanism and/or material. Moreover, the igniter may be disposed in any of a number of appropriate locations relative to the tracer composition and the projectile body. For instance, in one preferred embodiment, at least a portion of the tracer composition is disposed between the igniter and a portion of the projectile body.

Various refinements exist of the features noted in relation to one or more of the above-described aspects of the present invention. Further features may also be incorporated into one or more of those aspects as well. These refinements and additional features may exist individually or in any combination. For instance, the various features discussed below in relation to the illustrated embodiments may be employed in any of the those aspects, individually or in any combination.

DETAILED DESCRIPTION OF PREFERRED EMBODIMENTS

Figure 1:
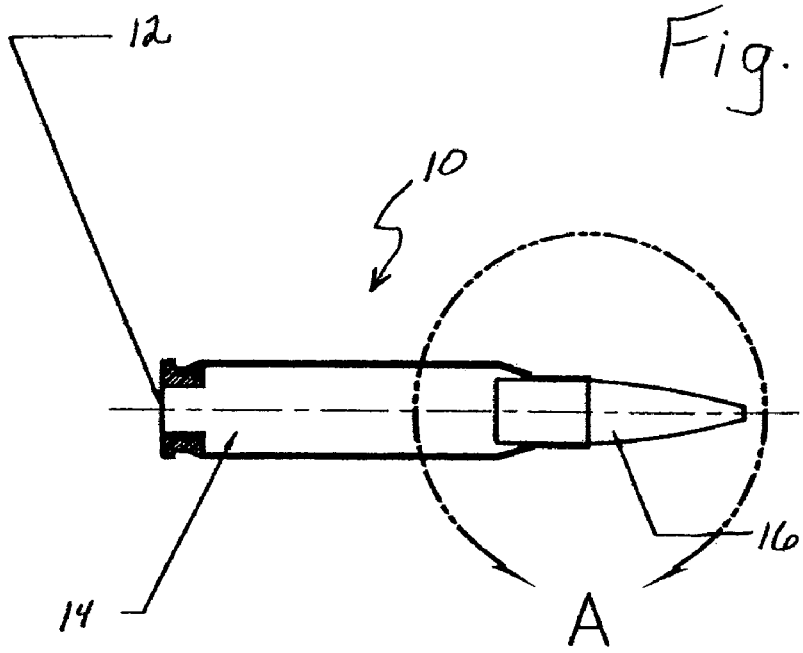
FIG. 1 is an elevation view of a rifle cartridge incorporating the invention.

The present invention will now be described in relation to the accompanying drawings, which at least assist in illustrating the various pertinent features thereof. FIG. 1 shows a rifle cartridge 10 that includes a primer 12, casing 14, and a projectile 16. The primer 12 may be any appropriate primer, may be any appropriate size, and may be made of any appropriate material. Likewise, the casing 14 may exhibit any of a number of appropriate designs/sizes and may be made of any of a number of appropriate materials. While not illustrated, the casing 14 of the rifle cartridge 10 generally has an appropriate propellant housed therein. This propellant is generally ignited (via an appropriate activation of the primer 12) to provide a propulsive force to the projectile 16 which causes an ejection of the projectile 16 from the casing 14.

Figure 2:
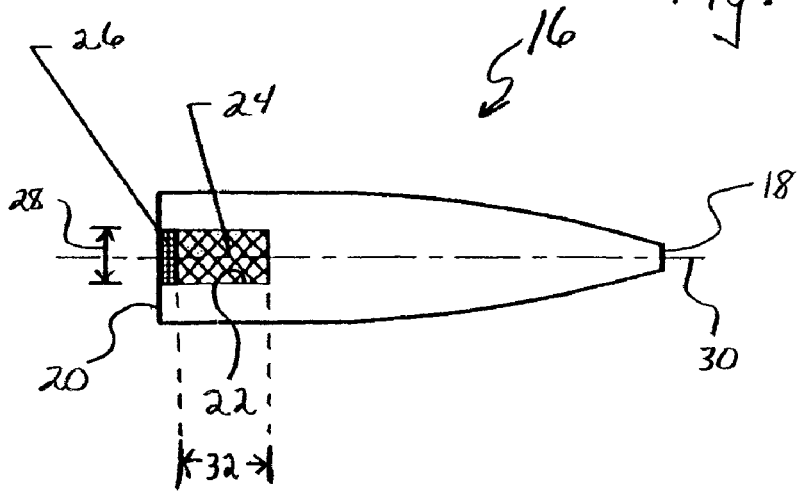
FIG. 2 is a cross-section view of a tracer projectile of the rifle cartridge of FIG. 1 at circle A.

The projectile 16 of the rifle cartridge 10 is illustrated in detail in FIG. 2. As shown, the projectile 16 has a leading end 18 and an opposing trailing end 20. A receptacle 22 is defined in the projectile 16 toward the trailing end 20 thereof. This receptacle 22 is utilized to accommodate a tracer composition 24 and an ignition composition 26. While the receptacle 22 may exhibit any of a number of appropriate designs, it is preferably substantially cylindrical.

Still referring to FIG. 2, the tracer composition 24 is disposed within the receptacle 22 of the projectile 16 and is positioned between the ignition composition 26 and the leading end 18 of the projectile 16. The ignition composition 26 and tracer composition 24 are formed as a substantially cylindrical pellet. It should be noted that other embodiments may exhibit other appropriate shapes/configurations of the pellet that includes the tracer composition 24 and the ignition composition 26.

Figure 3:
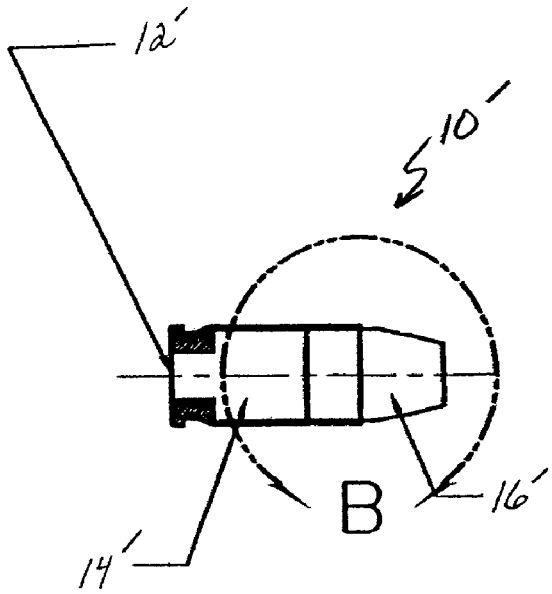
FIG. 3 is an elevation view of a pistol cartridge of the invention.
Figure 4:
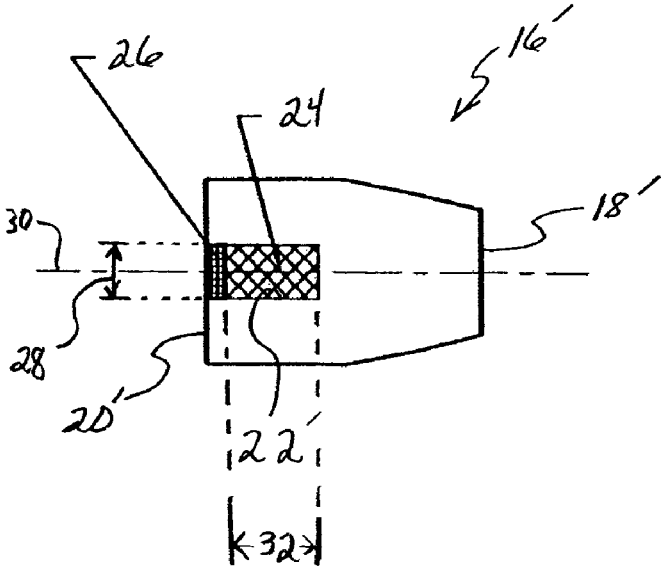
FIG. 4 is a cross-section view of a tracer projectile of the rifle cartridge of FIG. 3 at circle B.

FIG. 3 illustrates a variation of the cartridge 10 shown in FIG. 1, and as such, a "single prime" designation is used to identify cartridge 10'. Likewise, FIG. 4 illustrates a variation of the projectile 16 shown in FIG. 2, and as such, a "single prime" designation is used to identify the projectile 16'. Generally, the difference between the FIGS. 1-2 embodiment and the FIGS. 3-4 embodiment is that the cartridge 10 and corresponding projectile 16 are designed for use with rifles, while the cartridge 10' and the corresponding projectile 16' are designed for use with pistols. Accordingly, the pistol cartridge 10' includes a primer 12', casing 14', and the projectile 16'. The primer 12' may be any appropriate primer and may be any appropriate size. Likewise, the casing 14' may exhibit any of a number of appropriate designs and may be made of any of a number of appropriate materials. While not illustrated, inside the casing 14' of the pistol cartridge 10' generally has an appropriate propellant housed therein.

The projectile 16' of the pistol cartridge 10' is illustrated in detail in FIG. 4. As shown, the projectile 16' has a leading end 18' and an opposing trailing end 20'. A receptacle 22' is defined in the projectile 16' toward the trailing end 20' thereof. This receptacle 22' is utilized to accommodate the tracer composition 24 and the ignition composition 26. While the receptacle 22' may exhibit any of a number of appropriate designs, it is preferably substantially cylindrical.

Still referring to FIG. 4, the tracer composition 24 is disposed within the receptacle 22' of the projectile 16' and is positioned between the ignition composition 26' and the leading end 18' of the projectile 16'. The ignition composition 26 and tracer composition 24 are formed as a substantially cylindrical pellet. It should be noted that other embodiments may exhibit other appropriate shapes/configurations of the pellet that includes the tracer composition 24 and the ignition composition 26.

The tracer composition 24 shown in FIGS. 2 and 4 generally includes a tracer fuel, an oxidizer, and a burn rate stabilizer. The tracer fuel portion of the tracer composition 24 preferably includes magnesium and acrylic rubber. The acrylic rubber, at least in one embodiment, may be said to serve a dual purpose in that it is burned to provide a desired spectral output and is utilized as a binder of sorts to hold the tracer composition together in a pellet form. The oxidizer portion of the tracer composition 24 preferably includes polytetraflouroethylene (e.g., Telfon® available from E.I. du Pont de Nemours). Lastly, the burn rate stabilizer is preferably carbon black and/or graphite.

While amounts of the components of the tracer composition 24 may be varied from one embodiment to the next, certain of the preferred embodiments include about 48 to 64 parts by weight of magnesium, about 29 to 50 parts by weight of polytetraflouroethylene, about 2 to 7 parts by weight of acrylic rubber, and about 0.5 to 3 parts by weight of a burn rate stabilizer, such as carbon black or graphite. A preferred formulation of a tracer composition is about 58 parts by weight of magnesium, about 38 parts by weight of polytetrafluoroethylene, 4 parts of weight of acrylic rubber and about one and one-half parts by weight of carbon black or graphite.

The ignition composition 26 may have any of a number of appropriate make-ups. For instance, one preferred embodiment of the ignition composition 26 includes about 42.5 parts by weight of boron, about 55 parts by weight of potassium perchlorate, and about 5 parts by weight of vinylidene fluoride/hexfluoropropylene copolymer (Viton® from E.I. du Pont de Nemours). This ignition composition 26 is generally ignited due to ignition of the propellant in the casing 14. This ignition composition 26, then, generally functions to facilitate ignition of the tracer composition 24. It should be noted that the tracer composition 24 is the focus of the present invention, and accordingly, any manner of igniting the same to provide the desired spectral output is within the scope of the invention. A typical projectile will include tracer composition and igniter composition in a ratio of about 4 to 1.

The size of the pellet of the tracer composition 24 and the make-up of the tracer composition can affect the spectral output of the corresponding projectile. Output intensity is dependent upon the diameter of the column of the pellet. For instance, if it is desired to have a given tracer bullet of the invention emit almost no visible light but a sufficient amount of infrared light, a diameter 28 of the cylindrical pellet (measured perpendicular to reference axis 30) may be reduced to about 3/32 inch. This means that a diameter of the receptacles 22, 22' would also be about 3/32 inch.

Incidentally, a "sufficient amount" refers to an amount of light that enables a viewer to observe/detect the same unaided. For instance, a sufficient amount of visible light would be discernable by the naked eye. Further, a sufficient amount of infrared light would be discernable through the use of infrared vision equipment such as Generation III night vision goggles. Still further, "almost no visible light" refers to both no visible light, and an insignificant amount of visible light such that it may not be easily discerned by the naked eye.

If it is desired to have a given tracer projectile of the invention emit low, yet noticeable, amounts of visible light and a sufficient amount of infrared light, in size, the diameter of the cylindrical pellet may be increased to about ⅛ inch.

As still another example, if it is desired to have a given tracer projectile of the invention emit sufficient amounts of both visible and infrared light, the diameter 28 of the cylindrical pellet may be about 3/32 inch, but the tracer composition 24 preferably includes vinylidene fluoride/hexfluoropropylene copolymer instead of acrylic rubber. The preferred composition of the formulation is about 66 to 74 parts by weight of magnesium, about 8 to 13 parts by weight polytetrafluoroethylene and about 13 to about 18 parts by weight of vinylidene fluoride/hexafluoropropylene copolymer. A preferred embodiment of the formulation is about 70 parts by weight of magnesium, about 10.5 parts by weight of polytetrafluorethyloene and about 15.5 parts by weight of vinylidene fluoride/hexfluropropylene copolymer.

In all of these examples, a height 32 of the cylindrical pellet is preferably about 0.175 inch. It should be noted that other dimensions of the tracer composition 24 may be chosen depending on the desired results.

Figure 5:
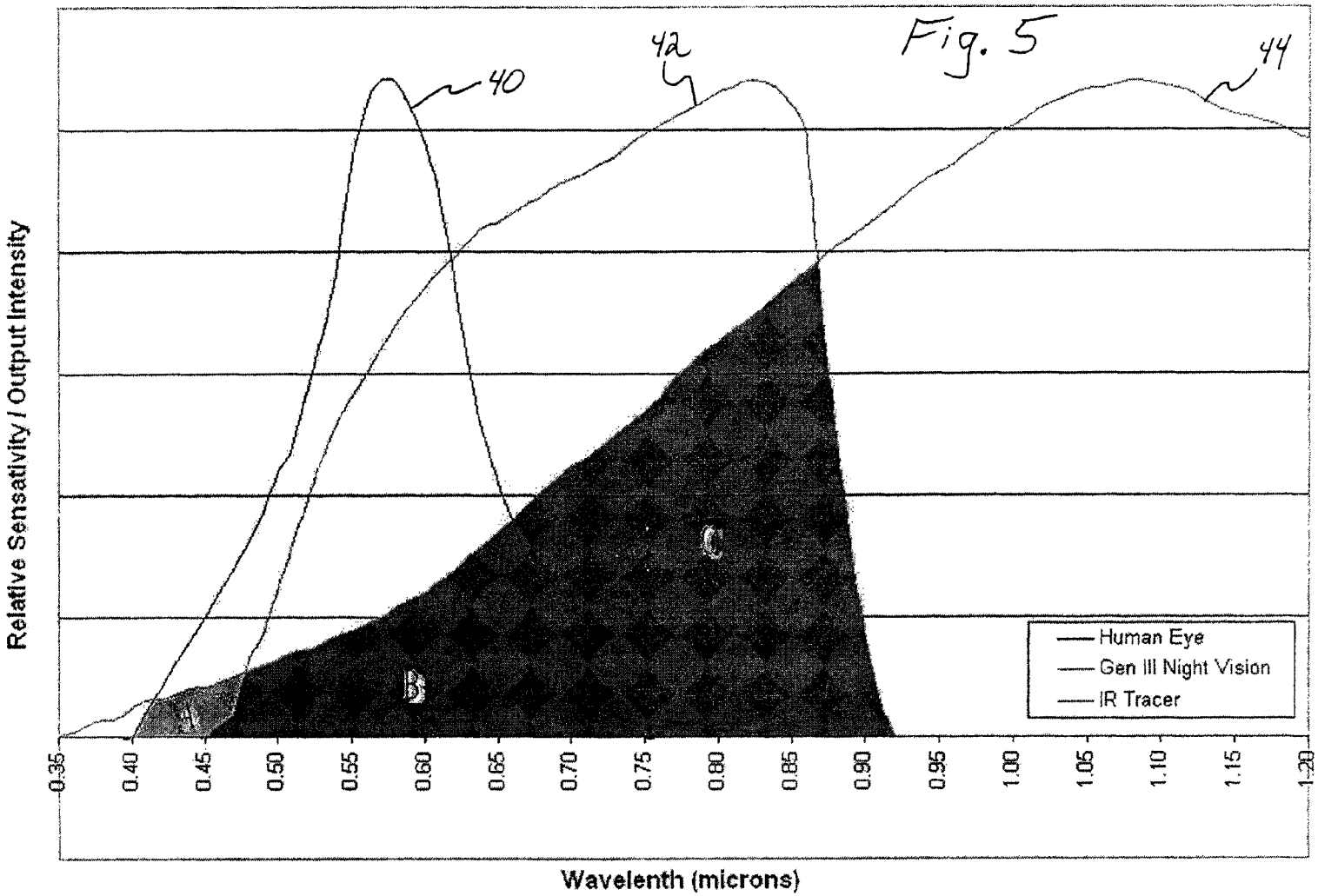
FIG. 5 is a graph illustrating spectral data of a tracer composition of the invention relative to what can be seen by the naked eye and what can be seen with Generation III night vision goggles.

FIG. 5 is a graph showing three curves 40, 42, 44 over a spectral wavelength range of about 0.3 5 microns to about 1.20 microns relating to relative output intensity at those particular wavelengths. In particular, the curve 40 is indicative of what light may be perceived by the naked human eye. This curve 40 extends from about 0.40 microns to about 0.75 microns with a peak sensitivity at about 0.57 microns. The curve 42 is indicative of what may be perceived by an individual using Generation III night vision goggles. This curve 42 extends from about 0.45 microns to about 0.93 microns with a peak sensitivity at about 0.83 microns. The curve 44 is indicative of the spectral output of the tracer composition 24 (when ignited) of the tracer bullets 10, 10'. This curve 44 extends from about 0.35 microns to at least about 1.20 microns with a peak intensity between about 1 micron and about 1.15 microns. While not illustrated, the curve 44 extends out to about 6 microns. While the range of spectral wavelengths produced by the tracer composition 24 may vary in some embodiment, the tracer composition 24 preferably exhibits a peak intensity between about 1.00 micron and about 1.15 microns, more preferably between about 1.05 microns and about 1.12 microns, and still more preferably about 1.08 microns.

Still referring to FIG. 5, the shaded area "A" is under the curve 40 (indicating what the naked human eye can detect) and the curve 44 indicates the spectral output of the ignited tracer composition 24, note that the spectral output of the tracer composition is quite low in this region and, thus, may be fairly difficult for the naked eye to discern. The shaded area "C" is under the curve 42 (indicating what a viewer can see using Generation III night vision goggles) and the curve 44 indicates the spectral output of the ignited tracer composition 24. Note that the spectral output of the tracer composition is quite high in this region and, thus, is fairly easy to detect through the use of Generation III night vision goggles. The shaded area "B" is under all three curves 40, 42, 44. Accordingly, the spectral output of the tracer composition 24 associated with area "B" falls within a wavelength range that is discernable both by the naked human eye and through the use of Generation III night vision goggles. However, the intensity of the tracer composition's spectral output in area "B" may enable it to be barely noticeable to the naked human eye. Note that the spectral output of the tracer composition 24 in area "B" is of a greater intensity than in area "A". However, the spectral output of the tracer composition 24 in area "C" is of a greater intensity than in areas "A" and "B". Accordingly, since the spectral output of area "C" can be observed through the use of Generation III night vision goggles, the spectral output of the tracer composition 24 may be said to be easily discernable with the use of Generation III night vision goggles and quite difficult to discern with the naked human eye. Indeed, the tracer composition 24 is capable of providing spectral output that enables Generation III night vision goggle-assisted sight to be about 2.5 times more sensitive to the tracer composition's spectral output compared to sensitivity of the naked human eye to such spectral output.

Those skilled in the art will appreciate that certain modifications can be made to the system and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

The invention claimed is:

1. A small caliber tracer projectile which, when fired from a small caliber cartridge produces a near infrared trace visible with Generation III night vision goggles and suppressed visible light predetermined by the selected cross-sectional configuration of the tracer pellet comprising:

a projectile body having a leading end, a trailing end, and a substantially cylindrical receptacle centrally disposed within the interior of said projectile body intermediate to said leading end and open to said trailing end, said receptacle loaded with a substantially cylindrical tracer pellet comprising a tracer composition adjoined with a tracer ignition composition;

said tracer composition comprising magnesium in an amount ranging between about 48% and about 64% by weight, polytetrafluoroethylene in an amount ranging between about 29% and about 50% by weight, acrylic rubber in an amount ranging between about 2% and about 7% by weight and a burn rate stabilizer in an amount ranging between about 0.5% and about 3% by weight;

said ignition composition positioned within said receptacle intermediate to said trailing end and said tracer composition for facilitating ignition of said tracer composition;

said ignition composition comprising about 42.5% by weight of boron, about 55% by weight of potassium perchlorate, and about 5% by weight of vinylidene fluoride/hexfluropropylene;

said tracer composition positioned inside of said receptacle and capable of emitting visible and infrared light upon ignition at wavelengths ranging between about 0.35 microns to about 1.2 microns with a peak intensity between about 1 micron and about 1.15 micron; and said tracer pellet having a cross-sectional diameter of about 3/32 inches to about ⅛ inches, whereby the light omitted by the tracer burn is controlled to the desired infrared light output by the predetermined cross-sectional configuration of the pellet.

2. The small caliber tracer projectile of claim 1 further comprising:

a length of said pellet of about 0.175 inches.

3. The small caliber tracer projectile of claim 1 further comprising:

a diameter of said receptacle is complementary in cross-section to the pellet and at least that of the pellet ranging between about 1/8 inches to about 3/32 inches.

4. The small caliber tracer projectile of claim 2 further comprising:

the diameter of the substantially cylindrical pellet substantially equivalent to a receptacle diameter; and a length of the substantially cylindrical receptacle substantially equivalent to the pellet length.

5. The small caliber tracer projectile of claim 1 wherein:

the burn rate stabilizer is selected from the group consisting of carbon black and graphite.

6. The small caliber tracer projectile of claim 1 wherein:

the substantially cylindrical pellet further comprises a ratio of about 4 parts tracer composition to about 1 part ignition composition.

* * * * *